US007112116B2

(12) United States Patent
Gräf et al.

(10) Patent No.: US 7,112,116 B2
(45) Date of Patent: Sep. 26, 2006

(54) PROCESS FOR PRODUCING AN ELECTRIC LAMP WITH OUTER BULB

(75) Inventors: Jürgen Gräf, Augsburg (DE); Andreas Hohlfeld, Berlin (DE); Michael Hülsemann, Schönwalde (DE); Anton Schlögl, Biberbach (DE); Karen Twesten, Berlin (DE)

(73) Assignee: Patent-Treuhand-Gesellschaft für elektrisch Glühlampen mbH, Munich (DE)

( * ) Notice: Subject to any disclaimer, the term of this patent is extended or adjusted under 35 U.S.C. 154(b) by 220 days.

(21) Appl. No.: 10/858,386

(22) Filed: Jun. 2, 2004

(65) Prior Publication Data

US 2004/0253897 A1 Dec. 16, 2004

(30) Foreign Application Priority Data

Jun. 5, 2003 (DE) ..... 103 25 554

(51) Int. Cl.
*H01J 9/00* (2006.01)
*H01J 9/38* (2006.01)
*H01J 9/26* (2006.01)

(52) U.S. Cl. ..... 445/26; 445/42; 445/43; 445/27; 445/53; 313/26

(58) Field of Classification Search ..... 445/26, 445/29, 53, 16, 19, 22, 27, 38, 42, 43, 56; 313/26

See application file for complete search history.

(56) References Cited

U.S. PATENT DOCUMENTS 4,949,003 A * 8/1990 Cox et al. ..... 313/25
5,064,395 A 11/1991 Kling
5,128,589 A 7/1992 Dakin
5,825,127 A 10/1998 Weinhardt
6,043,603 A 3/2000 Weinhardt
6,790,115 B1 * 9/2004 Fukai et al. ..... 445/26
2002/0063529 A1 5/2002 Fukai et al.
2002/0067115 A1 6/2002 Nagata et al.

FOREIGN PATENT DOCUMENTS

| | | |
|---|---|---|
| CA | 2 042 143 | 12/1991 |
| CA | 1 310 058 | 11/1992 |
| DE | 195 21 972 | 12/1996 |
| DE | 196 27 731 | 1/1998 |
| DE | 10159379 | 6/2002 |
| DE | 101 57 868 | 7/2002 |
| EP | 0 465 083 | 1/1992 |
| EP | 0 481 702 | 4/1992 |

* cited by examiner

*Primary Examiner*—Mariceli Santiago
*Assistant Examiner*—Anne M Hines
(74) *Attorney, Agent, or Firm*—William E. Meyer

(57) ABSTRACT

The process comprises the provision of a discharge vessel (2) which is closed off on one side, fitting a second tube over part of the discharge vessel and evacuating and filling the volume of the outer bulb via a pumping hole, which remains open in the second extension part within the second tube. This pumping hole is only closed at the end by means of an operation which closes it by rolling.

9 Claims, 7 Drawing Sheets

PROCESS FOR PRODUCING AN ELECTRIC LAMP WITH OUTER BULB

TECHNICAL FIELD

Reference is made to application Ser. No. 10/858,375 filed in parallel, which provides a more detailed description of a lamp with getter strip.

The invention relates to a process for producing an electric lamp with outer bulb and with an inner vessel, in particular a discharge vessel. It deals in particular with discharge lamps, such as metal halide lamps, but also incandescent halogen lamps.

BACKGROUND ART

US 2002/063 529 has disclosed a process for producing an electric lamp with an outer bulb, in which the outer bulb does not completely surround the inner vessel. Similar processes are described in US 2002/067 115 and U.S. Pat. No. 5,128,589. A variant with an outer bulb which completely surrounds the inner vessel is disclosed, for example, by CA 2 042 143.

U.S. Pat. No. 5,825,127 has disclosed a process for producing a cap strip for discharge lamps, the cap strip being a support strip comprising a material which is to be introduced into the lamp, in particular mercury and/or getter material as a coating. This unit is usually referred to as a getter strip. The only application area for getter and cap strips of this type envisaged by that document is the discharge vessel of a low-pressure mercury lamp. In this case, the getter or cap strip is often secured in the vicinity of an electrode, cf. also U.S. Pat. No. 6,043,603.

An example of an incandescent lamp with a getter in the outer bulb is to be found in CA-A 1 310 058.

DISCLOSURE OF THE INVENTION

It is an object of the present invention to provide a process for producing an electric lamp with outer bulb and with an inner vessel, in particular a discharge vessel, which process is simple and inexpensive. A further object is to reduce the number of components and to increase the speed of production by avoiding the need for prolonged processes.

This object is achieved by means of the following steps:

a) providing a hollow body made from glass, in particular a tube made from quartz glass, which defines an interior volume and has at least one opening;
b) supplying the hollow body or tube with at least one current bushing system which projects into the volume from the outside via the opening, the system in particular being an electrode system which comprises at least an electrode, a foil and a supply conductor;
c) evacuating and filling the internal volume;
d) heating and deforming the hollow body at the open end, so that a sealing part which surrounds a central part of the current bushing system in a gastight manner, and an extension part, which includes an outer part of the current bushing system, are formed, with a lateral opening (18) remaining in the blank formed in this way to act as a pumping hole;
e) fitting over a second hollow body made from glass, in particular a tube made from quartz glass of relatively large dimension, the dimension of the second hollow body being such that the second hollow body covers the internal volume, the sealing region and a certain part of the extension part, in particular a region amounting to from 10 to 60% of the length of the extension part, with the pumping hole also being enclosed in the covered region;
f) guiding the open end of the second hollow body, via a contact zone KO, onto the extension part, in particular by rolling or melting or fastening it on, in order to form an outer bulb, so that gastight contact is produced in the region of the extension part at least at the end of the contact zone KO, with the pumping hole located inside the contact zone;
g) evacuating and optionally filling the volume which extends between the inner vessel and outer bulb via the pumping hole and the open end of the extension part;
h) closing the outer bulb in the region of the contact zone by heating at least a part of the contact zone and subsequently guiding this part of the contact zone onto the adjacent part of the inner vessel.

Particularly advantageous configurations are to be found in the dependent claims.

The process according to the invention for producing an electric lamp with an outer bulb and an inner vessel relates predominantly to metal halide lamps. However, it may also apply to an incandescent halogen lamp with an outer bulb. One significant point is that in this case the outer bulb is secured direct to the inner vessel, and consequently there is no need for electrode systems for the outer bulb or holders for supply conductors passing through the outer bulb. There is no need for a frame. Furthermore, cement-free capping is desired, in which case ceramic cap parts are dispensed with. The contact pieces of the cap are simultaneously suitable as holders for the supply conductors. In a radical step, known pump rod techniques are dispensed with, both for the inner vessel and for the outer bulb. There is no need for protective sleeves for the supply conductors in the outer bulb. A similar statement applies to the loop bent in a V shape required for expansion compensation at the supply conductor in the outer bulb.

The production process in principle uses the following steps:

a) providing a hollow body made from glass, in particular a tube made from quartz glass, which defines an interior volume and has at least one opening; hard glass is also suitable, as is known per se;
b) supplying the hollow body or tube with at least one current bushing system which projects into the volume from the outside via the opening, the system in particular being an electrode system which comprises at least an electrode, a foil and a supply conductor;
c) evacuating and filling the internal volume;
d) heating and deforming the hollow body at the open end, so that a sealing part which surrounds a central part of the current bushing system in a gastight manner, and an extension part, which includes an outer part of the current bushing system, are formed, with a lateral opening remaining in the blank formed in this way to act as a pumping hole;
e) fitting over a second hollow body made from glass, in particular a tube made from quartz glass of relatively large dimension, in order to form an outer bulb, the dimension of the second hollow body being such that the second hollow body covers the internal volume, the sealing region and a certain part of the extension part, in particular a region amounting to from 10 to 60% of the length of the extension part, with the pumping hole also being enclosed in the covered region;
f) guiding the open end of the second hollow body, over the length of a contact zone KO, onto the extension part, in particular by rolling or melting or fastening it on, so that gastight contact is produced in the region of the extension part at least at the end of the contact zone KO, with the pumping hole located inside the contact zone;

g) evacuating and optionally filling the volume which extends between the inner vessel and outer bulb via the pumping hole and the open end of the extension part;

h) closing the outer bulb in the region of the contact zone by heating at least a part of the contact zone and subsequently guiding this part of the contact zone onto the adjacent part of the inner vessel.

Suitable methods for guiding a part of the contact zone onto the adjacent part of the inner vessel include in particular pinching, rolling or dropping on account of the application of a pressure difference, if appropriate with additional rolling or pinching.

A preferred embodiment is configured in such a way that that part of the contact zone which is to be closed is located at the height of the pumping hole, so that the pumping hole itself is thereby closed up.

Another preferred embodiment consists in that part of the contact zone which is to be closed being located within the height of the pumping hole, so that the pumping hole itself is not thereby closed up.

The process can be applied in particular to lamps in which the inner vessel and the outer bulb each have a single opening.

The process can be applied in particular to lamps in which the inner vessel and the outer bulb each have an additional, second opening.

In this case, the overall process preferably involves the following steps:

a) providing a tube made from quartz glass;

b) supplying the tube with in each case one electrode system at each end, the electrode system comprising an electrode, a foil, a supply conductor and a cap;

c) heating and deforming the tube at a first end, so that a central discharge volume, a sealing part, which includes the foil, and an extension part, which includes at least the external supply conductor, are formed;

d) evacuating and filling the discharge volume;

e) heating and deforming the tube at the second end, so that here too a sealing part, which includes the foil, and an extension part, which includes at least the outer supply conductor, are formed, with a lateral opening remaining in the blank formed in this way at the second extension part as a pumping hole;

f) fitting over a second tube made from quartz glass of larger diameter, in particular with a diameter which is larger by at least 30%, the length of the second tube being such that the second tube covers the discharge volume, the sealing region and a certain part of the extension part, in particular a region amounting to from 10 to 60% of the length of the extension part, with the pumping hole also being included in the covered region;

g) rolling or melting or fastening on the two ends of the second tube in order to form an outer bulb, so that at least a gastight contact is produced in the region of the extension part, with the pumping hole being located within the contact zone;

h) evacuating and optionally filling the volume which extends between inner vessel and outer bulb via the pumping hole and the still-open end of the second extension part;

i) closing the outer bulb, in particular the pumping hole.

To close the outer bulb, it is possible either to employ a further rolling step in order to close it up, in which case it is advantageous for the region which is to be closed up by rolling already to have been reduced to a significantly smaller diameter in the first rolling operation. The pumping hole may also be closed up by a simple dropping maneuver after suitable heating by means of the application of reduced pressure. A further alternative is to apply vacuum or reduced pressure with subsequent closure by pinching or rolling. One tried-and-tested heating technique is effected by means of a laser beam, or alternatively by plasma heating, or any other established process.

A typical application of the process is for metal halide lamps and incandescent halogen lamps.

BRIEF DESCRIPTION OF THE DRAWINGS

The text which follows is to explain the invention in more detail with reference to an exemplary embodiment.

In the drawings.

PREFERRED EMBODIMENT OF THE INVENTION

Figure 1:
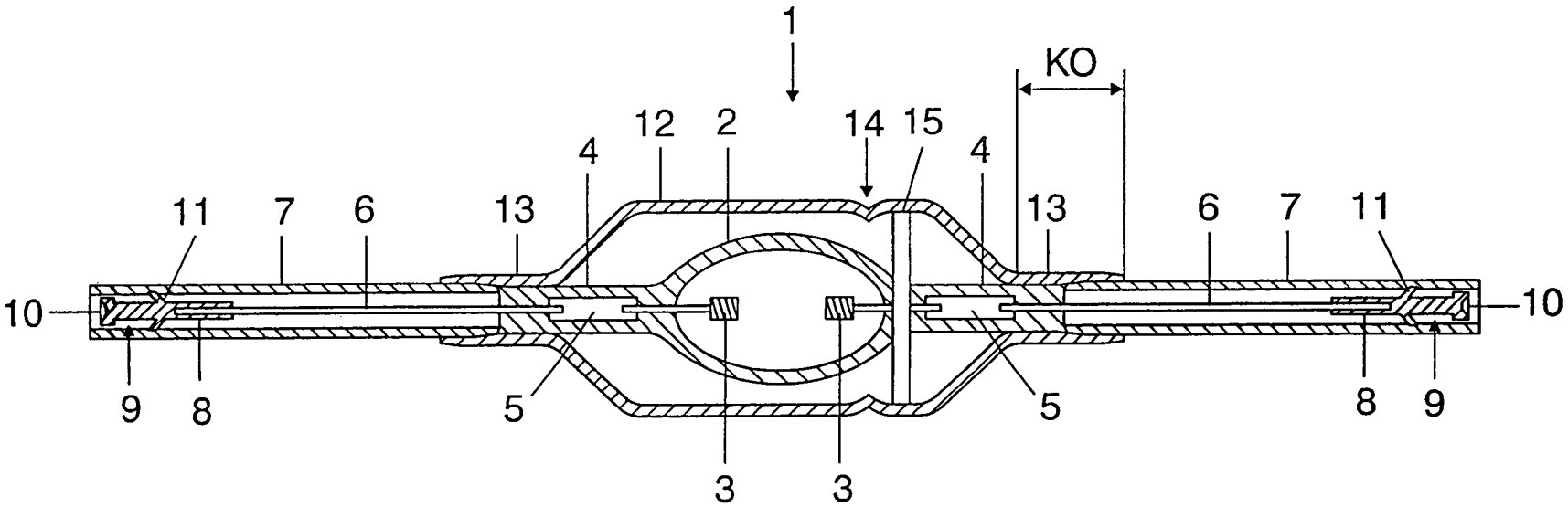
FIG. 1 shows a side view, in section, of a metal halide lamp.

FIG. 1 diagrammatically depicts a side view of a metal halide lamp 1 which is closed on two sides. The discharge vessel 2, which is configured as a barrel-shaped body made from quartz glass, encloses two electrodes 3 as well as a metal halide fill. The bulb ends are sealed by fused seals 4 into which foils 5 are embedded. These foils are connected to external supply conductors 6. The external supply conductor 6 is guided in a tubular sleeve 7 which forms an extension part and ends in a bush 8 of a cap part 9. The cap part 9 is made, for example, as a single part from steel and also comprises a circular disk 10 as contact element and barb 11 as centering and holding means. The part of the discharge vessel which bulges out is surrounded by an outer bulb 12 which is rolled on in the region of the transition between the fused seal 4 and the sleeve 7 and forms a contact zone KO (13). The outer bulb 12 has an encircling indentation 14, so that an elastic support strip 15 made from stainless steel or nickel-plated iron is spread open on the inner surface of the outer bulb without being able to slip laterally. The support strip contains getter materials, such as Zr, Fe, V, Co. These materials serve to absorb various substances, such as oxygen, hydrogen or the like. The outer bulb may be filled with nitrogen, another inert gas or vacuum. In this embodiment, the contact zone KO bears completely against the inner vessel.

To protect the supply conductor 6, it is possible, as shown in FIG. 8, for a foil 19 to be arranged at the rear end of the extension part, sealed by means of a pinch 21'.

Figure 2:
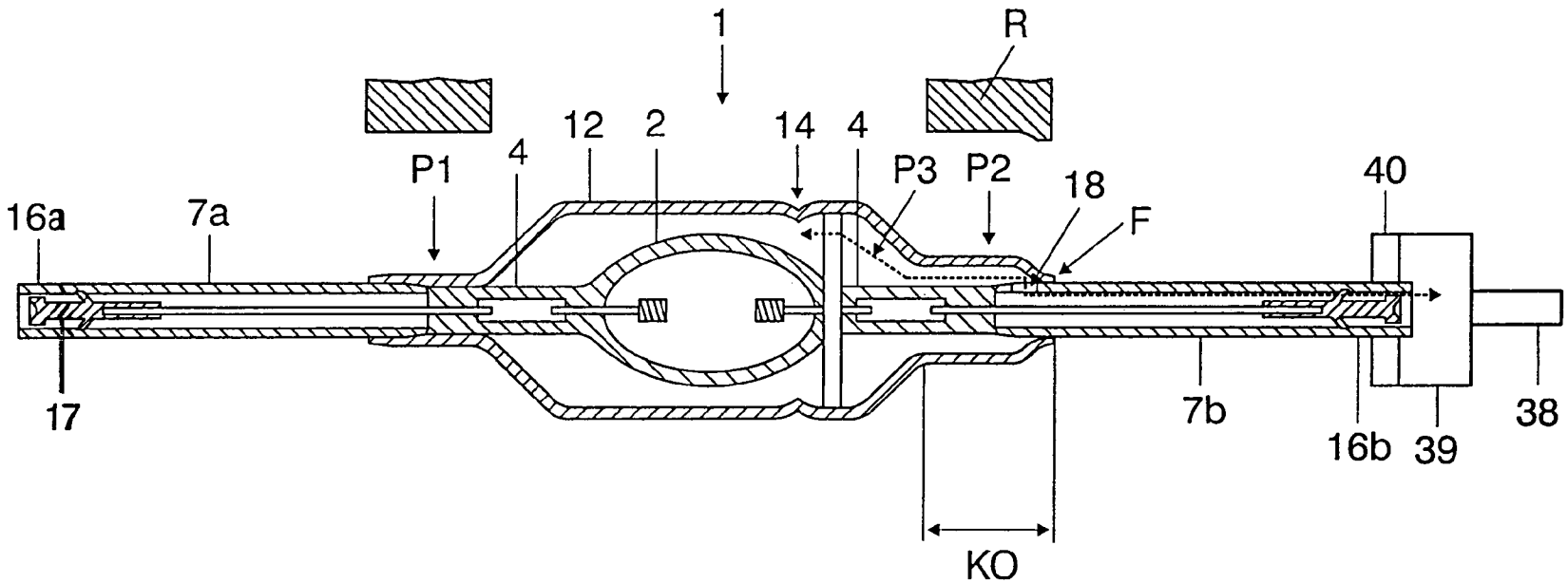
FIG. 2 shows a production process in highly diagrammatic form for the lamp shown in FIG. 1.

A production method is described as follows with reference to FIG. 2: first of all, the discharge vessel 2 is completed from a cylindrical tube, by means of a forming roll and possibly pinching jaws, which in each case fix an electrode system which has been introduced into the still-open tube, for example by pitching, up to the stage in which it is provided with a seal (pinch or fused seal 4) at both ends. At the same time, integrally attached sleeve-like extension parts 7 remain in place at the seals 4. External supply conductors and optionally cap parts are located in the extension parts. In this context, it is irrelevant whether and how any cap part is secured in the extension part. Normally, the cap part is at most mechanically anchored, specifically on both sides in the extension parts 7*a* and 7*b*. A significant factor is that a pumping hole 18 be produced at the second extension part 7*b* in the vicinity of the sealing part, for example by means of laser, and this pumping hole initially remains open.

The cylindrical outer bulb 12 is initially an open tube. It is first of all pretreated in such a way that an encircling indentation 14 laterally fixes a support strip which has previously been clamped in place. The ends of the outer bulb are then, after prior heating by flames, guided onto the end of the sealing part and the start of the extension part 16. In the process, the first end is rolled on completely (arrow P1). At the second end, although the diameter is reduced, not all of the contact zone KO is brought into contact with the inner vessel. Instead, the fixing F is effected by means of the suitably shaped roll R at the second extension part 16*b* outside the still-open pumping hole 18. At the height of the pumping hole 18, therefore, the outer bulb 19 has been rolled on but not in such a way that it bears against the extension part 16*b* (arrow P2). This arrangement is connected to a pumping and filling system 39 at the open end of the second extension part via a feedline 38, in particular by a pumping rubber 40 being fitted onto the end of the extension part. It is now possible for the atmosphere in the outer bulb to be pumped out. The pumping path is indicated by arrow P3.

Figure 3:
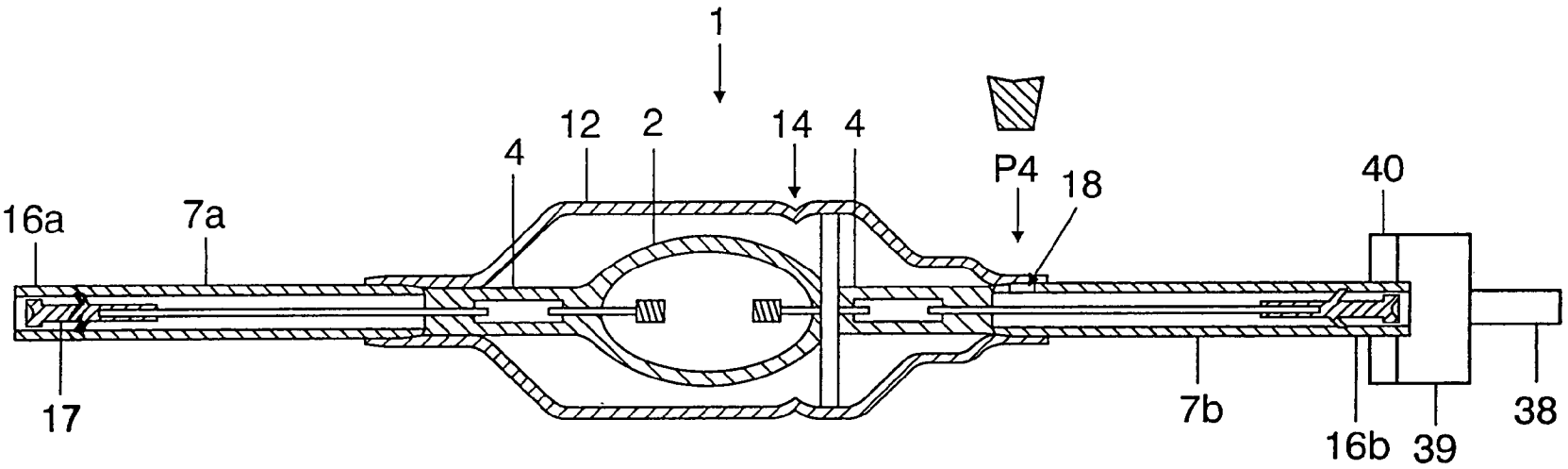
FIGS. 3 to 7 show further exemplary embodiments for the production of lamps.

Then, the outer bulb 12 can be supplied with a substantially inert atmosphere via this pumping path or a vacuum can be maintained. In the next step, the pumping hole 18 is closed off, for example either by being closed by rolling, specifically locally over a short section of the contact zone, or simply by the material automatically dropping into place after local heating by means of laser with the application of a reduced pressure, cf. in each case arrow P4 (FIG. 3).

Figure 4:
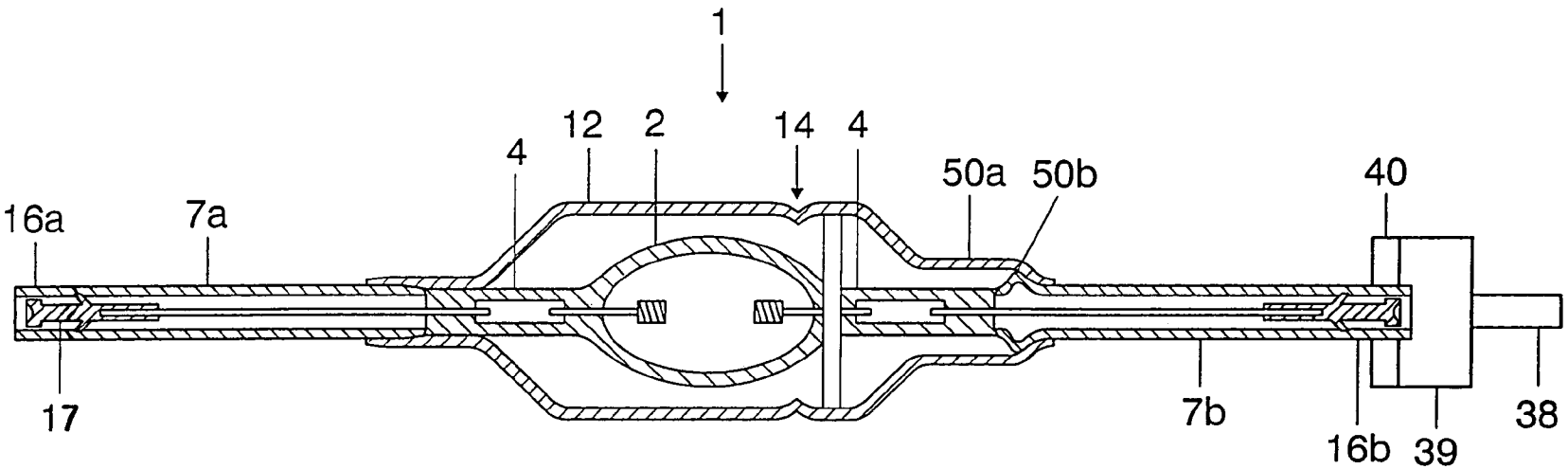

FIG. 4 shows an exemplary embodiment in which the pumping hole is closed by this zone being locally heated and then the region 50*b* of the extension part being pressed mechanically from the inside onto that part 50*a* of the outer bulb which has been guided on.

The end 16*b* of the second extension part normally remains open. The getter strip 15 may, if required for the getter used, subsequently be activated through the outer bulb 12 by means of laser.

Figure 5:
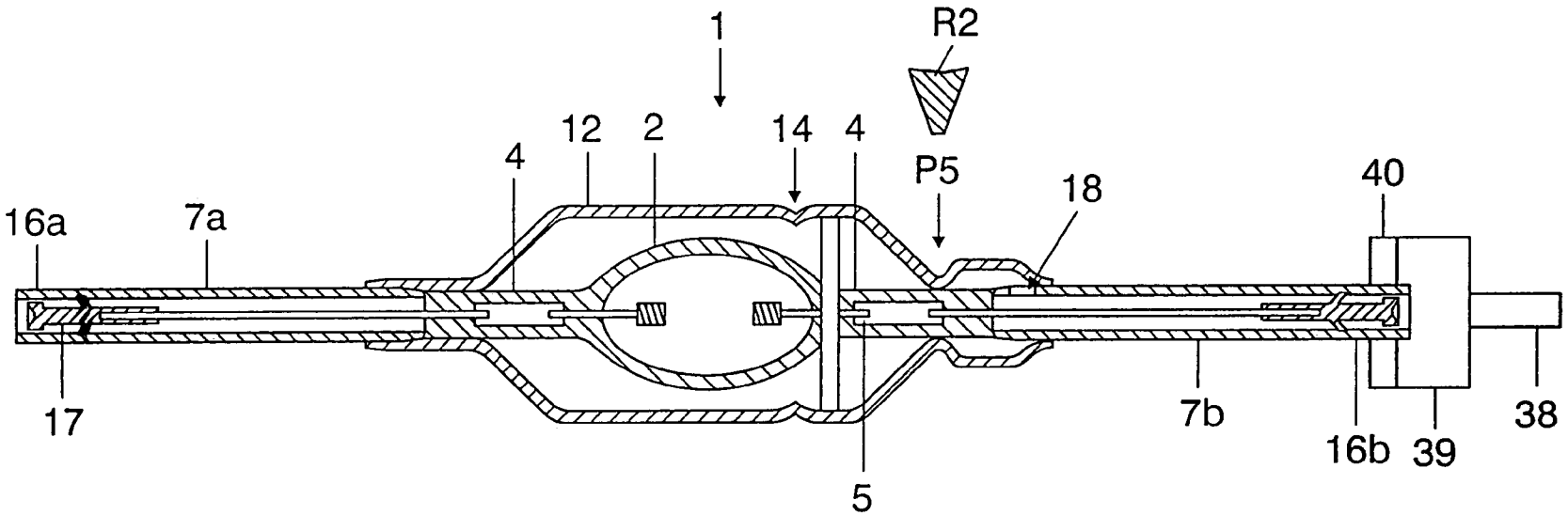

An alternative is for the pumping hole to remain open and instead for the outer bulb to be closed off further toward the inside, cf. FIG. 5. For this purpose, after prior heating a narrow roll R2 is guided onto the inner end of the contact zone (arrow P5), so that contact is made with the inner vessel approximately at the height of the end of the foil 5. The pumping hole 18 remains open. In this way, optimum dissipation of heat is achieved, protecting the foil.

Figure 6:
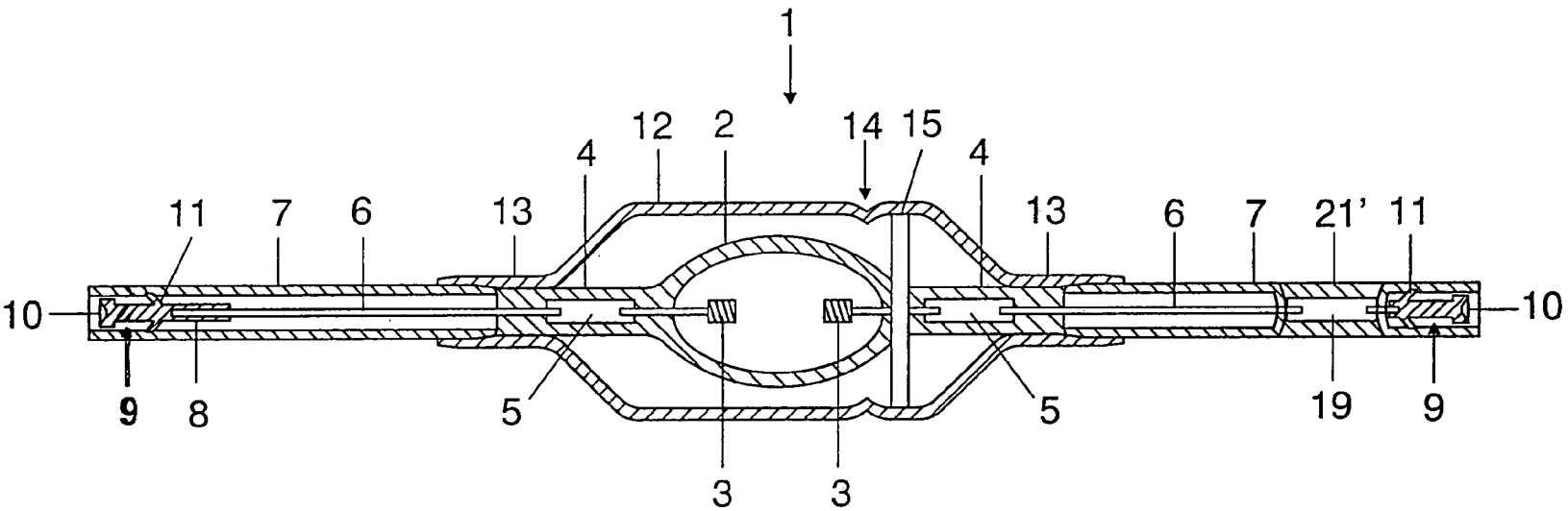

FIG. 6 shows a lamp similar to that shown in FIG. 1, with a foil 19 having been applied to the end of the extension part. The outer wall of the tubular extension part 7 at the height of the foil is heated and pinched (21') after the outer bulb has been closed.

For this purpose, the volume of the extension part is advantageously evacuated in advance and if appropriate filled with inert gas. In this way, it is possible to delay corrosion of the outer parts of the supply conductor.

Figure 7:
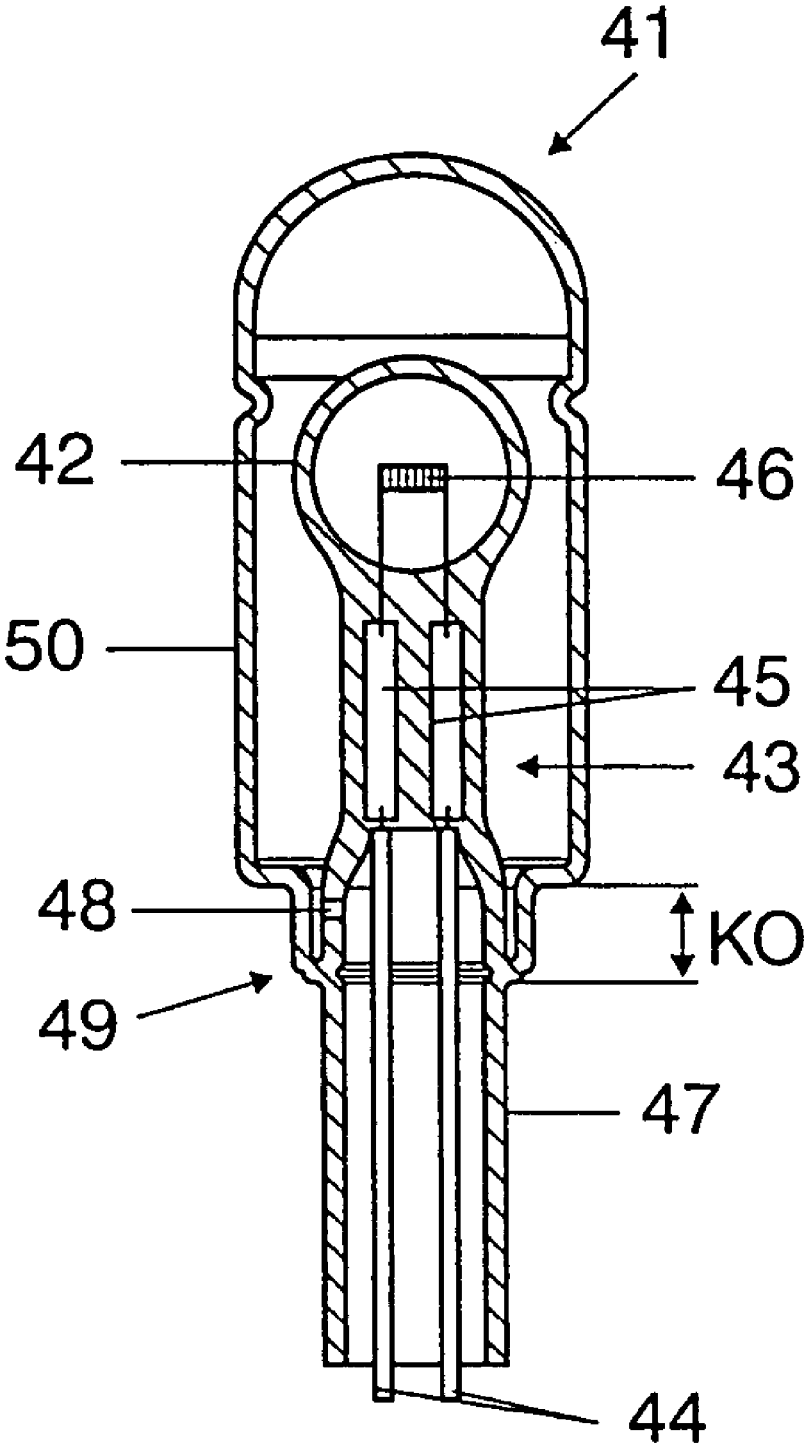

FIG. 7 shows an embodiment of an incandescent halogen lamp 41 which is closed on one side and in which a pear-shaped inner vessel 42 has a single opening 43 which is closed by a pinch as a sealing part. The current bushing system includes two external supply conductors 44, which are connected via foils 45 to a luminous body 46 in the interior of the inner vessel.

The external supply conductors 44 are guided in a tubular extension part 47 which laterally has a pumping hole 48 in the vicinity of the sealing region. An outer bulb 50 surrounds the inner vessel, the sealing region and a short part of the extension part, typically from 10 to at most 35% thereof. The end of the outer bulb is heated and guided onto the extension part 47, similarly to in FIG. 2. In the process, the outermost end 49 is rolled or fastened onto the extension part, while the remaining region of the contact zone is only guided to near the extension part. The pumping hole is enclosed in the covered region of the contact zone KO. The volume of the outer bulb can then be evacuated via the pumping hole 48 and if appropriate filled. Then, the region of the pumping hole is heated using a laser, so that the contact zone automatically drops onto the pumping hole as a result of the application of a reduced pressure at the end of the extension part, in a similar manner to that which has been described above in the case of two-sided lamps. Of course, the other methods described in detail above are also suitable for this purpose.

The invention claimed is:

1. A process for producing an electric lamp with outer bulb and with an inner vessel, in particular a discharge vessel, arranged therein, in which the following process steps are used:

a) providing a hollow body made from glass which defines an interior volume and has at least one opening;

b) supplying the hollow body or tube with at least one current bushing system which projects into the volume from the outside via the opening, the current bushing system being an electrode system which comprises at least an electrode, a foil and a supply conductor;

c) evacuating and filling the internal volume;

d) heating and deforming the hollow body at the open end, so that a sealing part which surrounds a central part of the current bushing system in a gastight manner, and an extension part, which includes an outer part of the current bushing system, are formed, with a lateral opening remaining in the extension part formed in this way to act as a pumping hole;

e) fitting over a second hollow body made from glass, being a tube made from glass of relatively large dimension, the dimension of the second hollow body being such that the second hollow body covers the internal volume, the sealing region and a certain part of the extension part, being a region amounting to from 10 to 60% of the length of the extension part, with the pumping hole also being enclosed in the covered region;

f) guiding the open end of the second hollow body, via a contact zone, onto the extension part, sealing the second hollow body along the contact zone to the extension part, in order to form an outer bulb, so that gastight contact is produced in the region of the extension part at least at the end of the contact zone, with the pumping hole located inside the contact zone;

g) evacuating and filling the volume which extends between the inner vessel and outer bulb via the pumping hole and the open end of the extension part;

h) closing the outer bulb in the region of the contact zone by heating at least a part of the contact zone and subsequently guiding this part of the contact zone onto the adjacent part of the inner vessel.

2. The process as claimed in claim 1, wherein the operation of guiding a part of the contact zone onto the adjacent part of the inner vessel is effected by pinching, rolling or dropping on account of the application of a pressure difference.

3. The process as claimed in claim 1, wherein the part of the contact zone which is to be closed is located at the height of the pumping hole, so that the pumping hole itself is thereby closed.

4. The process as claimed in claim 1, wherein the part of the contact zone which is to be closed is located within the height of the pumping hole, so that the pumping hole itself is not thereby closed.

5. The process as claimed in claim 1, wherein the inner vessel and the outer bulb each have a single opening.

6. The process as claimed in claim 1, wherein the inner vessel and the outer bulb each have an additional, second opening.

7. The process as claimed in claim 6, wherein, as an additional process step bc prior to step c, the additional opening is supplied at least with a current bushing system, and the tube is heated and deformed at its additional opening, with an additional sealing part, which includes an outer part of the current bushing system, including a foil as a central part of the current bushing system, and an extension part, which includes an outer part of the current bushing system, being formed.

8. The process as claimed in claim 1, wherein the inner vessel is a discharge vessel, the current bushing system comprising electrodes, and in that the fill comprises metal halides.

9. The process as claimed in claim 1, wherein the current bushing system comprises a luminous body.

* * * * *